US006439679B1

(12) United States Patent
Roylance

(10) Patent No.: US 6,439,679 B1
(45) Date of Patent: Aug. 27, 2002

(54) PULSE WITH MODULATION SIGNAL GENERATING METHODS AND APPARATUSES

(75) Inventor: Eugene A. Roylance, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/888,122

(22) Filed: Jun. 22, 2001

(51) Int. Cl.[7] ..... B41J 29/38

(52) U.S. Cl. ..... 347/9; 332/109; 332/110

(58) Field of Search ..... 332/106–109; 370/205; 375/238; 327/31, 141 T, 144, 175; 347/240, 237, 251, 252 PWM, 9, 11, 13, 14, 196 PWM

*Primary Examiner*—Robert Pascal
*Assistant Examiner*—Kimberly E Glenn

(57) ABSTRACT

A pulse width modulator (PWM) circuit is provided. The PWM circuit includes a selective synchronization circuit configured to receive vector signals, and selectively synchronize the vector signals. The synchronized vector signals are provided to a tap selection circuit configured to output tap selection signals that are logically combined by a transition generating circuit to produce a pulse width modulated signal based on logically detected transitions in the tap selection signals.

22 Claims, 6 Drawing Sheets

PULSE WITH MODULATION SIGNAL GENERATING METHODS AND APPARATUSES

TECHNICAL FIELD

The present invention relates generally to pulse width modulation techniques, and more particularly to pulse width modulation methods and apparatuses for use in various devices.

BACKGROUND

In the past, pulse width modulation techniques have been used in the context of control signal generation and also for electronic converters/inverters. Such converters/inverters tend to employ square-wave switching waveforms, wherein the pulse width is varied in order to control a load voltage. Such techniques have also been employed, for example, in the design/fabrication of integrated circuits (ICs) having pulse width modulators (PWMs).

One conventional technique for implementing a PWM utilizes a design solution wherein the PWM is run with a much higher clock frequency to generate the desired signal pulse widths and pulse justifications. The required clock frequency for a PWM is typically proportional to the resolution, or granularity, of the pulse widths that can be generated. Thus, for example, where pulse widths ranging from 0 to 64 can be specified, in increments of 1/64th of the output period, many conventional solution techniques would require a clock frequency that is 64 times the clock frequency. Consequently, the resulting clock frequencies could exceed 1 GHz, which is often very difficult/expensive to implement in a conventional IC.

Another conventional technique for implementing a PWM utilizes an analog voltage ramp circuit to calculate periods of time. The resulting circuit requires calibration of the ramp circuit to a desired frequency. A desired pulse width number, or value, is converted to a voltage value for the ramp reference voltage. The voltage value is proportional to the pulse width. A pulse is initiated when the voltage ramp begins, and ends when the ramp voltage reaches the reference voltage. Here, the reference voltage is generated from the pulse width input using a digital-to-analog converter (DAC). Such designs require only the clock frequency to drive the control logic. However, such designs also require sensitive analog circuitry typically cannot be implemented in a digital-only IC. Currently, digital-only ICs tend to be the least expensive type of ICs to manufacture. Mixed analog and digital ICs are generally more expensive and more difficult to design and fabricate.

Therefore, there exists a need for an improved PWM that can be implemented on an IC as well as other types of circuits in a manner that is efficient in operation, cost-effective, and/or substantially accurate.

SUMMARY

Improved pulse width modulation methods and apparatuses are provided that can be implemented in an IC as well as other types of circuits.

The above stated needs and others are met, for example, by an improved pulse width modulator (PWM) circuit, in accordance with certain exemplary implementations of the present invention. The improved PWM circuit includes a selective synchronization circuit that is configured to receive vector signals, and output corresponding synchronized vector signals. The PWM further includes a tap selection circuit that is coupled to the selective synchronization circuit and configured to receive the synchronized vector signals and in response output selected timing signals that can be logically combined to produce a desired pulse width modulated signal.

BRIEF DESCRIPTION OF THE DRAWINGS

A more complete understanding of the various methods and apparatuses of the present invention may be had by reference to the following detailed description when taken in conjunction with the accompanying drawings wherein.

DETAILED DESCRIPTION

As used herein, a pulse width modulator (PWM) is understood to be a circuit that generates a pulse in the form of an electrical signal. In the exemplary implementations presented herein, the resulting pulse has a pulse width that is selectively controlled by providing the PWM with a control signal(s) that defines or otherwise correlates to a desired pulse width.

In the examples that follow, the pulse width is essentially the time that the signal is in an active state (e.g., logical high). The pulse can be justified within a period of time, in which it is generated, to some pre-defined position(s). For example, the pulse can be justified to the left, right, or center position of an output period. However, it is understood that other justifications could also be defined. In accordance with certain aspects of the present invention, a PWM is provided with a pulse code input that defines both width and justification, once every output period. Here, output period refers to clock period, which is the inverse of the frequency of the clock that is driving the PWM.

As described below, an exemplary PWM employs delay-line technology to generate several independent clock signals or tap signals based on a clock signal. Each rising edge of a tap signal occurs at a time that linearly progresses across the period associated with one cycle of the clock signal. The tap signals are thusly configured to occur at possible transition points of the output pulse width modulated signal. Hence, if a pulse width has a resolution of thirty-two, then at least thirty-two tap signals are needed. A resolution of thirty-two means pulse width increments of $1/32^{nd}$ of the period can be specified. In certain exemplary implementations, thirty-two tap signals are provided with increasing delays such that the tap signals are spread equally across the period of the clock cycle. As such, a tap signal associated with a desired pulse width modulated signal can be selected via a signal or data, which initiates the output of the PWM to change. A block diagram of such construction will be described below in greater detail with reference to FIGS. 1–5. Certain exemplary uses of the PWM circuitry, as presented in FIGS. 1–5, are presented in FIGS. 6–7.

Figure 1:
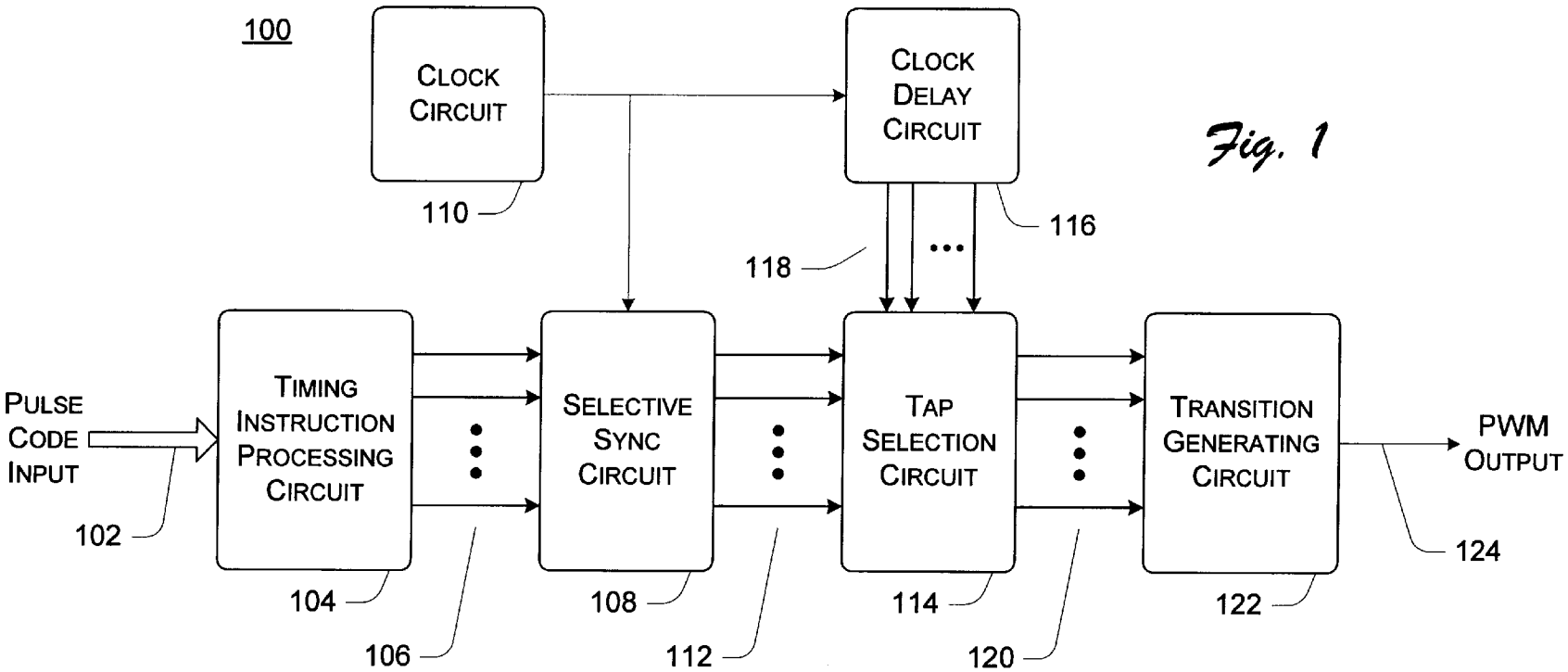
FIG. 1 is a block diagram depicting selected operative portions of a pulse width modulator (PWM) circuit, in accordance with certain exemplary implementations of the present invention.

With this in mind, FIG. 1 is a block diagram depicting certain operative portions of an exemplary PWM circuit 100.

PWM circuit 100 is essentially a multiple purpose PWM in that it is configured to be adaptable to a variety of circuits, devices and/or systems. In this disclosure PWM circuit 100 is shown as being adapted for use in a printer, in accordance with certain implementations of the present invention. However, it is noted that this is by way of example only and is not intended to limit the scope and/or applicability of the multiple purpose pulse width modulation methods and apparatuses provided herein.

With this in mind, PWM circuit 100 is configured to receive a pulse code input 102. In certain exemplary implementations, pulse code input 102 includes a multiple bit instruction that defines a desired operational state of PWM 100. More particularly, with regard to an exemplary printer implementation, certain bits within pulse code input 102 identify the justification (e.g., left, center, right) and pulse width associated with a desired dot that will eventually be printed on a print media (e.g., a print out). Pulse code input 102 may be provided by a variety of circuits, including, for example, a programmed processor or other like logic (not shown).

In the example depicted in FIG. 1, pulse code input 102 is provided to a timing instruction processing circuit 104, which is configured to generate a corresponding vector output 106 that indicates where/when timing transitions associated with the PWM output 124 of PWM circuit 100 should occur. In certain printer implementations, for example, these timing transitions provided at PWM output 124 are used to selectively control the operation of a laser diode in creating an applicable representation of the desired dot on a photo conducting drum. In certain other printer implementations, for example, the timing transitions provided at PWM output 124 are used to selectively control the operation of an ink jet head in creating the desired dot on a media.

Vector output 106, which includes a plurality of vector signals, is provided as an input to a selective synchronization circuit (sync circuit) 108. The output from a clock circuit 110 (e.g., a clock signal) is also provided as an input to sync circuit 108. Sync circuit 108 is configured to selectively alter each of the vector signals in vector output 106, as needed to better synchronize the operation of PWM circuit 100. For example, sync circuit 106 can be employed in an effort to eliminate meta-stability problems. Any meta-stability event would likely cause unacceptable errors in the output. The meta-stability errors may, for example, occur in logic circuits, such as those in PWM 100, due to process, voltage, and/or temperature differences.

Sync circuit 108 provides a synchronized vector output 112, which includes a corresponding plurality of synchronized vector signals, to a tap selection circuit 114. As depicted, tap selection circuit 114 is further arranged to receive a plurality of tap signals 118 as output by a clock delay circuit 116. Clock delay circuit 116 is arranged to receive the output from clock circuit 110. Clock delay circuit 116 is configured to generate the plurality of tap signals 118, wherein each tap signal is a time delayed version of the clock signal output by clock circuit 110.

Tap selection circuit 114 is configured to respond to the tap signals 118 and generate a tap selection output 120 having a plurality of tap selection signals based on respective synchronized vector signals.

Tap selection output 120 is provided to a transition generating circuit 122. Transition generating circuit 122 is configured to generate PWM output 124 based on the plurality of tap selection signals.

Figure 2:
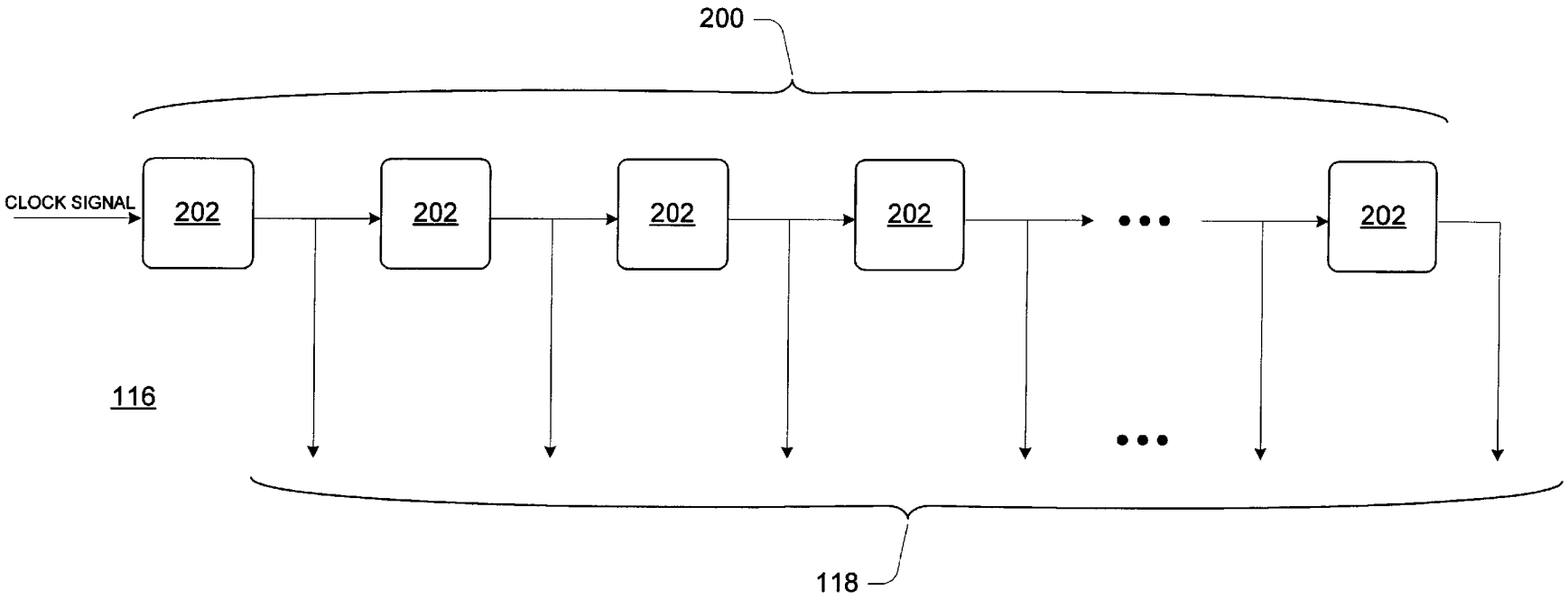
FIG. 2 is a block diagram depicting a clock delay portion of the PWM circuit of FIG. 1, in accordance with certain exemplary implementations of the present invention.

Reference is now made to FIG. 2, which depicts, in greater detail, clock delay circuit 116, in accordance with certain exemplary implementations of the present invention. Here, the clock signal from clock circuit 110 (FIG. 1) is provided to a delay chain 200 that includes a series of delay cells 202. The number of delay cells 202 in delay chain 200 is dependent upon the overall timing requirements that PWM circuit 100 is designed to meet in a given implementation. Thus, for example, in theory, the number of delay cells 202 required depends on the pulse width of the clock signal and the shortest desired pulse width to be output by PWM circuit 100. Thus, to divide the pulse width of the clock signal into sixty-four shorter pulse widths would theoretically require sixty-four delay cells 202. In certain instances, however, additional delay cells 202 may be required to further account for potential process, voltage, and/or temperature operational differences. Clock delaying circuitry, such as can be employed in delay cells 202, can include a variety of passive, active, and logic circuit components, as is well known to those skilled in the art.

As depicted in FIG. 2, delay chain 200 is configured to delay the clock signal beginning with the initial delay cell 202. The delayed output (i.e., tap signal 118) from the initial delay cell 202 is then tapped and also provided as an input to the next delay cell 202 in delay chain 200. Similarly, progressing through delay chain 202, the still further delayed output (i.e., tap signal 118) from each subsequent delay cell 202 is tapped and also provided as an input to the next subsequent delay cell 202. In this manner, each tap signal 118 output by clock delay circuit 116 is a delayed version of the clock signal.

In accordance with certain implementations, each delay cell 202 in delay chain 200 is designed to delay its inputted signal by a fixed and substantially equivalent period of time. It is assumed that the fixed delay provided by delay cells 202 will vary with process, temperature, and voltage. Therefore, a calibration process will likely need to be conducted, possible with some system interaction. For example, one exemplary calibration process measures the cell delay and then loads a translation or look-up table, or the like, with the locations of taps in a delay cell chain that most closely match the ideal or desired delays.

Figure 3:
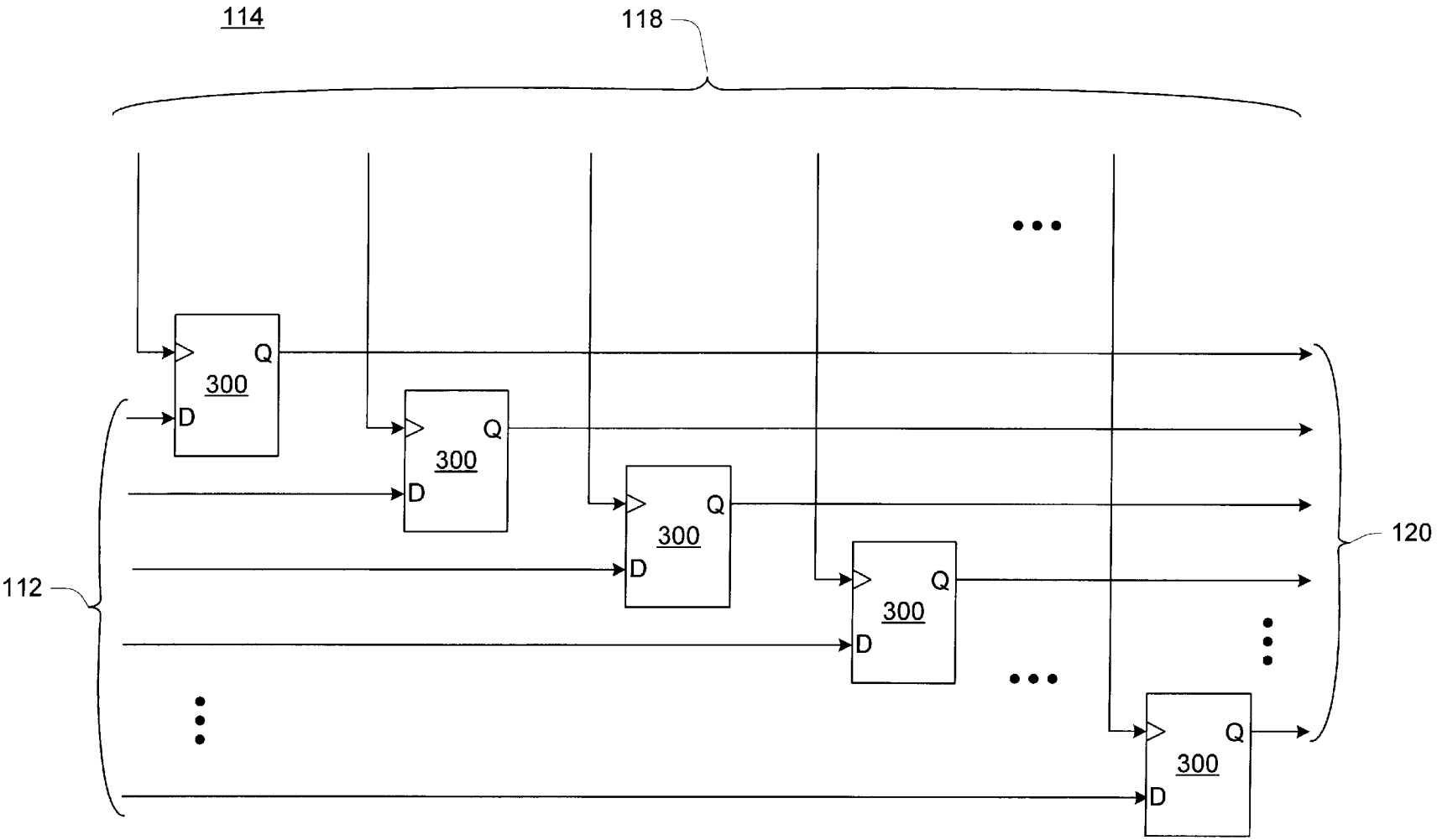
FIG. 3 is a block diagram depicting a tap selection portion of the PWM circuit of FIG. 1, in accordance with certain exemplary implementations of the present invention.

With this in mind, FIG. 3 is a block diagram depicting tap selection circuit 114, in greater detail, in accordance with certain exemplary implementations of the present invention.

As depicted, tap selection circuit 114 includes a plurality of flip-flops 300. In this example, flip-flops 300 are D flip-flops. A clock input in each flip-flop 300 is configured to receive a respective tap signal 118 from an associated delay cell 202 in delay chain 200. For example, the tap signal 118 from the initial delay cell 202 is provided as a clock input in an initial flip-flop 300. Consequently, each flip-flop 300 is essentially clocked at a progressively increased point in time with respect to the clock signal.

A data input in each flip-flop 300 is also configured to receive a different, corresponding synchronized vector input 112 from sync circuit 108 (FIG. 1). The tap selection signal generated by each flip-flop 300 is based on the logic state associated with the data input at the time of a transition in the clock input (tap signal 118). Thus, to affect PWM output 124 at a specific point in time associated with a particular tap signal 118, an associated synchronized vector signal can be selectively, logically toggled to cause the associated flip-flop 300 to change its logical state at the time of the next transition at its clock input.

Figure 4:
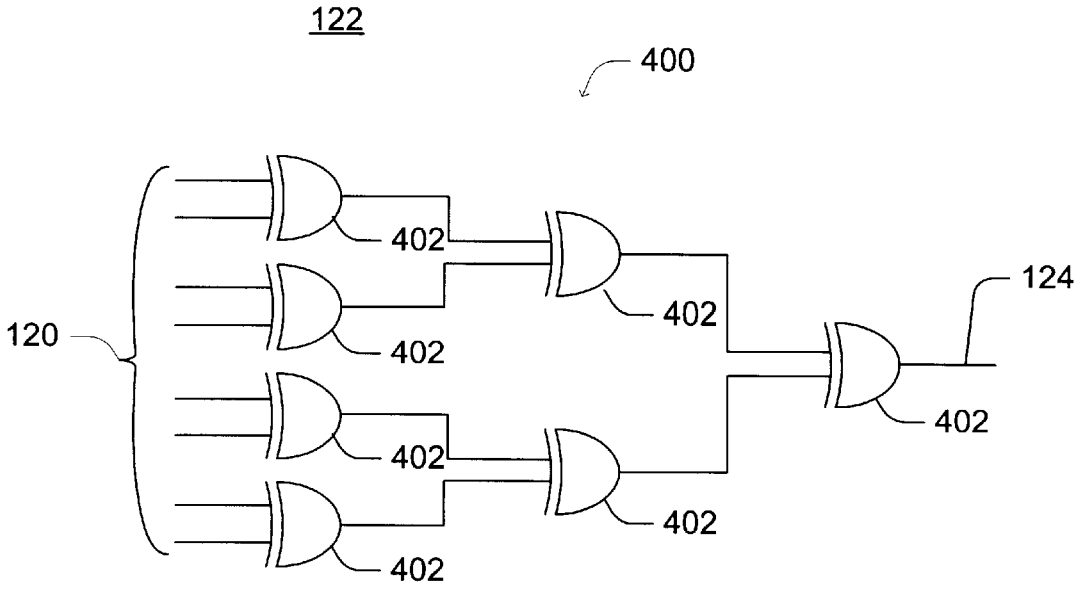
FIG. 4 is a block diagram depicting a transition generating portion of the PWM circuit of FIG. 1, in accordance with certain exemplary implementations of the present invention.

FIG. 4 is a block diagram further depicting transition generating circuit 122, in accordance with certain exemplary implementations of the present invention. Here, transition generating circuit 122 includes a hierarchical logic tree 400 having a plurality of exclusive OR (XOR) gates 402 in several levels. Each of the tap selection signals 120 is provided as an input to one of the initial level XOR gates 402. There are two inputs for each XOR gate 402. Hence, the number of initial level XOR gates 402 required will be equal to ½the number of flip-flops 300 (FIG. 3). The resulting logical output from each of the initial level XOR gates 402 is then provided to a next higher level XOR gate 402. As illustrated in the example in FIG. 4, similar level-to-level configurations are continued until a single, highest-level XOR gate 402 is reached. The output from this highest-level XOR gate 402 is then provided as PWM output 124.

In this manner, a state change to one of the flip-flops 300, as represented by a transition change on its outputted tap selection signal, will logically change PWM output 124.

Figure 5A:
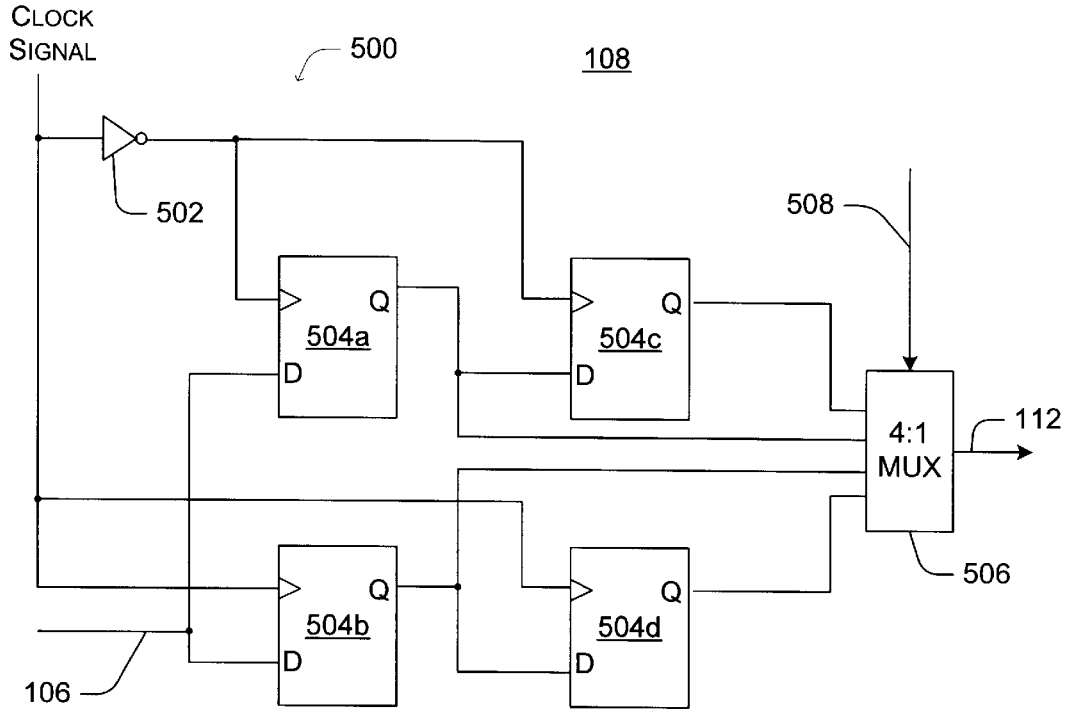
FIG. 5*a* is a block diagram depicting a selectable synchronization portion of the PWM circuit of FIG. 1, in accordance with certain exemplary implementations of the present invention.

FIG. 5*a* is a block diagram depicting, in greater detail, a portion 500 of sync circuit 108. Here, portion 500 depicts logic associated with a single vector signal 106. Thus, portion 500 would essentially be replicated for each of the vector signals in vector output 106, as output by timing instruction processing circuit 104 FIG. 1).

Portion 500 is further configured to receive the clock signal output by clock circuit 110. As shown, the clock signal is provided to the input of an inverter 502 and to a clock input of a flip-flop 504*b*. The output of inverter 502, which is an inverted clock signal, is provided to a clock input of flip-flop 504*a*. Vector signal 106 is provided to the data inputs of both flip-flops 502*a–b*. The output from flip-flop 504*a*is provided to a data input of flip-flop 504*c*, which is also clocked by the inverted clock signal from inverter 502. The output from flip-flop 504*b* is provided to a data input of flip-flop 504*d*, which is clocked by the clock signal. In certain other implementations, portion 500 includes additional clock signal inverters and flip-flops to provide for additional selective synchronized vector signals. Note that each inverter also imparts an inherent delay on the clock signal. Thus, a plurality of delayed/normal/inverted clock signals can thusly be generated.

With this in mind, the output from each flip-flop 502*a–d* is then provided to a 4:1 multiplexer 506. Multiplexer 506 is configured to selectively output a synchronized vector signal that matches a selected input based on a select input 508. Here, with a four-input multiplexer, select input 508 selects between the outputs from flip-flop 502*a–d*.

In this manner, portion 500 is configured to best synchronize a vector signal input. For example, the proper setting of select input 508 will cause the resulting synchronized vector signal 112 to better account for potential process, voltage, and/or temperature operational differences in PWM circuit 100. Moreover, a synchronized vector signal 112 that is provided to the data input of a corresponding flip-flop 300 needs to be sufficiently stable prior to the arrival of the next tap signal 118 from the respective delay cell 202. Hence, for example, in certain implementations synchronized vector signal 112 needs to be strategically asserted prior to the transitioning of the tap signal 118 from a logical low value to a logical high value, and maintained also for some time thereafter (e.g., during a set-up and hold period). This can be achieved, for example, by using portion 500 to selectively synchronize the vector signal 106 prior to providing it to tap selection circuit 114.

The setting of select input 508 can occur during initial testing of PWM circuit 100. Alternatively, the setting of select input 508 may be operatively controlled by additional logic that is configured to detect meta-stability problems or other timing issues, and take appropriate corrective actions.

Figure 5B:
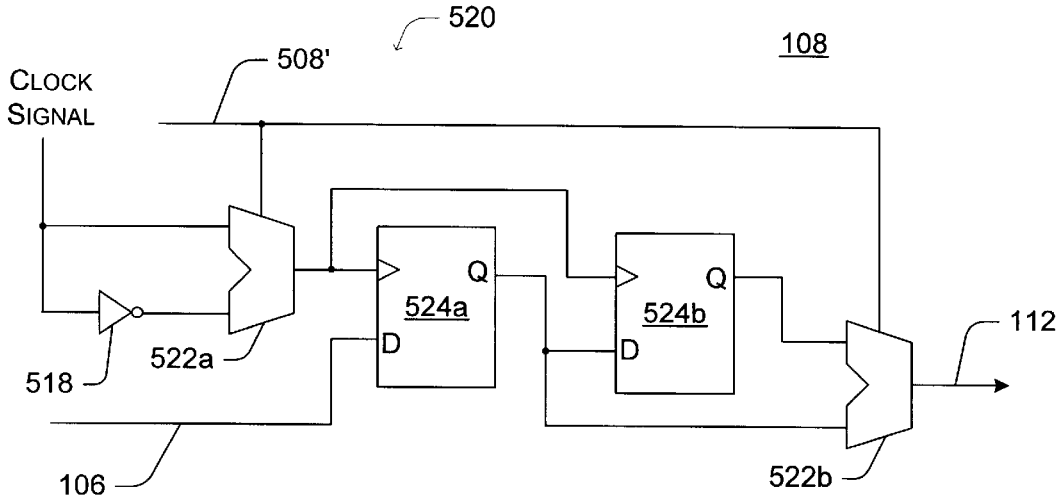
FIG. 5*b* is a block diagram depicting a selectable synchronization portion of the PWM circuit of FIG. 1, in accordance with certain other exemplary implementations of the present invention.

FIG. 5*b* is a block diagram depicting another selectable synchronization portion 520, in accordance with certain further exemplary implementations of the present invention.

Here, a select input 508' is provided to a multiplexer 522*a*, which causes either the clock signal or an inverted clock signal (from an inverter 518) to be applied to clock inputs of flip-flops 524*a* and 524*b*. As shown, a vector signal 106 is applied to a data input of flip-flop 524*a*. The output of flip-flop 524*a*is provided to a data input of flip-flop 542*b* and also to one input of a multiplexer 522*a*. The output of flip-flop 524*b* is provided to another input of multiplexer 522*b*, which is also selectively controlled via select input 508'. Multiplexer 522*b* outputs selected synchronized vector signal 112.

Those skilled in the art will recognize that the various circuits depicted in the exemplary implementations of FIGS. 2 through 5*a–b* can be implemented using alternative or different conventional electronic components, logic gates, flip flops, etc. Furthermore, while these exemplary circuits have been designed for implementation in an application specific integrated circuit (ASIC), other conventional circuit/logic design/fabrication techniques may be employed.

Figure 6:
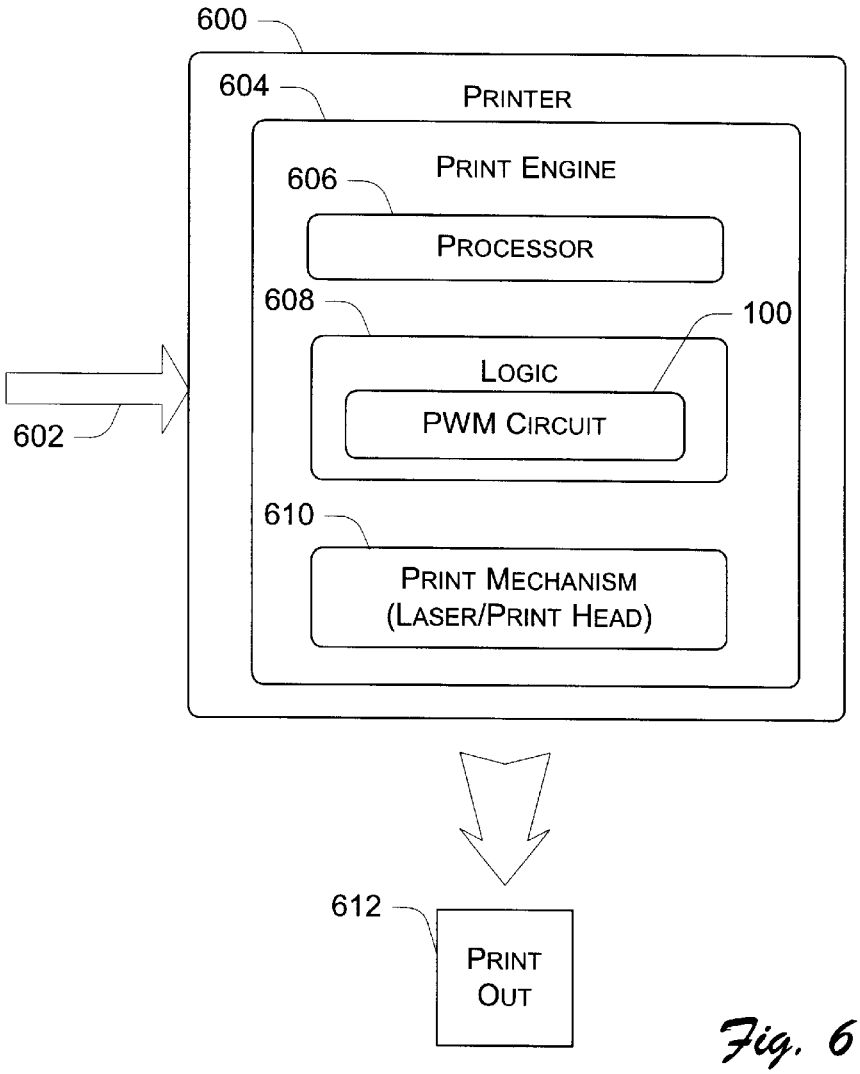
FIG. 6 is a block diagram depicting a printer having the PWM circuit of FIG. 1, in accordance with certain exemplary implementations of the present invention.

FIG. 6 is a block diagram depicting a printer 600, in accordance with certain implementations of the present invention. Printer 600 is configured to receive a print job 602 or like data from another device, such as, e.g., a computer (not shown). Printer 600 includes a print engine 604 having a processor 606 that is operatively coupled to logic 608 and configured to receive and process print job 602. Here, logic 608 includes PWM circuit 100, for example, as described above, which is configured to provide PWM output 124 to a print mechanism 610 (e.g., having a laser, a print head, or the like). Print mechanism 610 is operatively configured to generate a print output 612.

Figure 7:
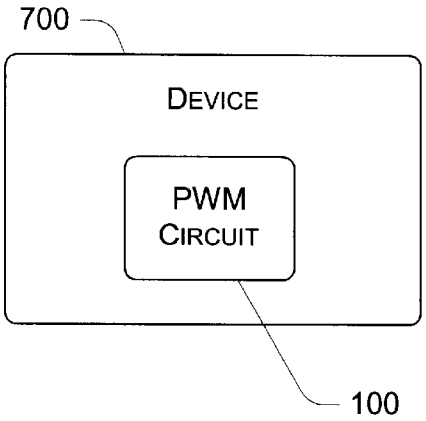
FIG. 7 is a block diagram depicting a device having the PWM circuit of FIG. 1, in accordance with certain further exemplary implementations of the present invention.

FIG. 7 is a block diagram depicting a device 700 having operatively configured therein, a PWM circuit 100, in accordance with certain further implementations of the present invention. Device 700 may be any apparatus that requires pulse width modulation or similar timing elements, and more preferably selectable pulse width modulation and the like. Thus, by way of example only, device 700 may include a computer device, a computer peripheral device, a data storage device, a communications device, a network device, an imaging device, an image processing device, an entertainment device, a control device, a robotic device, and other like devices.

Thus, although some preferred embodiments of the various methods and apparatuses of the present invention have been illustrated in the accompanying Drawings and described in the foregoing Detailed Description, it will be understood that the invention is not limited to the exemplary implementations disclosed, but is capable of numerous rearrangements, modifications and substitutions without departing from the spirit of the invention as set forth and defined by the following claims. For example, those skilled in the art will clearly recognize that other equivalent components can be used to perform the functionality provided in the exemplary circuitry and logic implementations as described herein.

What is claimed is:

1. An apparatus comprising:

a selective synchronization circuit configured to receive a plurality of vector signals, and selectively synchronize the plurality of vector signals to produce a corresponding plurality of synchronized vector signals; and a tap selection circuit operatively coupled to the selective synchronization circuit and configured to receive the plurality of synchronized vector signals and in response output tap selection signals.

2. The apparatus as recited in claim 1, further comprising a timing instruction processing circuit that is operatively coupled to the selective synchronization circuit and configured to receive a pulse code input and in response output the plurality of vector signals.

3. The apparatus as recited in claim 1, further comprising:

a clock circuit operatively coupled to the selective synchronization circuit and configured to generate and output a clock signal, and wherein the selective synchronization circuit is further configured to selectively alter the phase of the at least one vector signal and output the corresponding plurality of synchronized vector signals based on the clock signal.

4. The apparatus as recited in claim 3, further comprising:

a clock delay circuit that is operatively coupled to the tap selection circuit and the clock circuit, and configured to receive the clock signal and provide a plurality of tap signals to the tap selection circuit, wherein each of the plurality of tap signals is a uniquely delayed representation of the clock signal.

5. The apparatus as recited in claim 4, wherein the clock delay circuit includes a delay chain comprising a plurality of delay cells that are operatively coupled together and arranged in series, and wherein the clock signal is provided to the delay chain and propagated through the plurality of delay cells with each delay cell being configured to further delay the clock signal and output a corresponding tap signal.

6. The apparatus as recited in claim 5, wherein, within the tap selection circuit, each of the plurality of tap signals are used to time the outputting of a respective tap selection signal associated with a corresponding synchronized vector signal.

7. The apparatus as recited in claim 6, further comprising:

a transition generating circuit operatively coupled to the tap selection circuit and configured to receive the plurality of tap selection signals and in response output a pulse width modulated signal.

8. The apparatus as recited in claim 7, wherein the transition generating circuit is configured to alter the pulse width modulated signal as a result of a transition in at least one of the tap selection signals.

9. The apparatus as recited in claim 8, wherein the transition generating circuit includes a plurality of logic gates arranged in a hierarchical tree having a plurality of hierarchical levels, wherein each logic gate has two inputs and one output and wherein each tap selection signal is provided to an input of an associated logic gate arranged at the lowest level of the hierarchical tree, such that a transitional change in at least one of the tap selection signals will logically propagate from the lowest level to the highest level of the hierarchical tree, which includes one logic gate that outputs the pulse width modulated signal.

10. The apparatus as recited in claim 9, wherein the plurality of logic gates includes a plurality of exclusive OR gates.

11. The apparatus as recited in claim 4, wherein the tap selection circuit includes a plurality of flip-flops each having a clock input and a data input, and wherein the clock input of each flip-flop is configured to receive a different one of the plurality of tap signals, and the data input of each flip-flop is configured to receive a different synchronized vector signal.

12. The apparatus as recited in claim 3, wherein the selective synchronization circuit includes:

at least one inverter operatively configured to receive the clock signal and output a corresponding inverted clock signal that is time delayed;

a first flip-flop that is operatively coupled to the inverter and configured to receive one of the plurality of vector signals at a data input and output a corresponding synchronized vector signal based on the inverted clock signal, which is provided to a clock input of the first flip-flop;

at least one additional flip-flop that is operatively coupled to the clock circuit and configured to receive one of the plurality of vector signals at a data input and output a corresponding synchronized vector signal based on the clock signal received from the clock circuit, which is provided to a clock input of the additional flip-flop; and a multiplexer operatively coupled to receive a first synchronized vector signal from the first flip-flop, an additional synchronized vector signal from the at least one additional flip-flop, and at least one select input signal, and wherein the multiplexer selectively outputs either the first synchronized vector signal or the additional synchronized vector signal as one of the plurality of synchronized vector signals in response to the at least one select input signal.

13. The apparatus as recited in claim 12, wherein the at least one select input signal is preset.

14. The apparatus as recited in claim 12, wherein the at least one select input signal is dynamically controlled.

15. The apparatus as recited in claim 1, wherein the apparatus is a pulse width modulator (PWM).

16. A printing device comprising:

first logic configured to process a print job by generating a plurality of corresponding pulse code inputs;

second logic operatively coupled to the first logic and configured to receive at least one pulse code input from the first logic, convert the pulse code input into a corresponding plurality of vector signals, generate a corresponding plurality of synchronized vector signals, generate a plurality of tap signals that are selectively delayed representations of a clock signal, use the synchronized vector signals and the plurality of tap signals to generate a corresponding plurality of tap selection signals, and generate a pulse width modulated signal based on at least one transitional change detected in the plurality of tap selection signals; and a printing mechanism operatively coupled to the second logic and configured to receive the pulse width modulated signal and in response generate a printed output associated with the print job.

17. The printing device as recited in claim 16, wherein the printing device is a laser printer and the printing mechanism includes a laser.

18. The printing device as recited in claim 16, wherein the printing device is an ink jet printer and the printing mechanism includes a print head.

19. A device comprising:

a pulse width modulator that is configured to receive at least one pulse code input, convert the pulse code input into a corresponding plurality of vector signals, generate a corresponding plurality of synchronized vector signals, generate a plurality of tap signals that are selectively delayed representations of a clock signal, use the synchronized vector signals and the plurality of tap signals to generate a corresponding plurality of tap selection signals, and generate a pulse width modulated signal based on at least one transitional change detected in the plurality of tap selection signals.

20. The device as recited in claim 19, wherein the device is selected from a group of devices comprising a computer device, a computer peripheral device, a data storage device, a communications device, a network device, an imaging device, an image processing device, an entertainment device, a control device, and a robotic device.

21. A pulse width modulator comprising:

a clock circuit configured to provide a clock signal;

a clock delay circuit coupled to the clock circuit and configured to receive the clock signal and in response output a plurality of tap signals each of which is a different time delayed representation of the clock signal;

a timing instruction processing circuit configurable to receive a pulse code input and in response output a plurality of vector signals;

a selective synchronization circuit coupled to the clock circuit and the timing instruction processing circuit and configured to receive the clock signal and the plurality of vector signals and in response output a plurality of synchronized vector signals;

a tap selection circuit coupled to the clock delay circuit and the selective synchronization circuit and configured to receive the plurality of tap signals and the plurality of synchronized vector signals and in response output a plurality of tap selection signals; and a transition generating circuit coupled to the tap selection circuit and configured to receive the plurality of tap selection signals and in response output a pulse width modulated signal.

22. A method comprising: to a corresponding plurality of receiving at least one pulse code input;

converting the pulse code input into a corresponding plurality of vector signals;

selectively converting the plurality of vector signals into a corresponding plurality of synchronized vectors signals;

generating a plurality of tap signals that are selectively delayed representations of a clock signal;

generating a plurality of top selection signals based on the synchronized vector signals and the plurality of top signals; and generating a pulse width modulated signal based on the least one transitional change detected in the plurality of top selection signals.

* * * * *

UNITED STATES PATENT AND TRADEMARK OFFICE

CERTIFICATE OF CORRECTION

PATENT NO. : 6,439,679 B1
DATED : August 27, 2002
INVENTOR(S) : Eugene A. Roylance It is certified that error appears in the above-identified patent and that said Letters Patent is hereby corrected as shown below:

Column 10,
Lines 30 and 35, “top” should read -- tap --.

Signed and Sealed this

Twelfth Day of August, 2003

JAMES E. ROGAN
*Director of the United States Patent and Trademark Office*